US007175040B2

(12) United States Patent
Lorenz et al.

(10) Patent No.: US 7,175,040 B2
(45) Date of Patent: Feb. 13, 2007

(54) COLLAPSIBLE CONTAINER FOR TRANSPORT AND STORAGE OF GOODS

(75) Inventors: Reinhard Lorenz, Schwerin (DE); Axel Sommer, Tacoma, WA (US)

(73) Assignee: Arca Systems AB, Perstorp (SE)

( * ) Notice: Subject to any disclaimer, the term of this patent is extended or adjusted under 35 U.S.C. 154(b) by 0 days.

(21) Appl. No.: 10/446,969

(22) Filed: May 28, 2003

(65) Prior Publication Data

US 2004/0104230 A1 Jun. 3, 2004

(30) Foreign Application Priority Data

Dec. 3, 2002 (SE) ..... 0203613

(51) Int. Cl.
*B65D 6/00* (2006.01)
*B65D 8/14* (2006.01)

(52) U.S. Cl. ..... 220/6

(58) Field of Classification Search ..... 220/6, 220/1.5, 265, 266, 315, 7, 214, 258.1, 324, 220/807, 210; 206/1.5; 411/508
See application file for complete search history.

(56) References Cited

U.S. PATENT DOCUMENTS 3,796,342 A * 3/1974 Sanders et al. ..... 220/6
3,870,185 A * 3/1975 Sanders et al. ..... 220/6
4,523,692 A * 6/1985 Lemkin ..... 220/788
4,658,980 A * 4/1987 Lindstrom ..... 220/214
4,798,304 A * 1/1989 Rader ..... 220/6
4,863,056 A * 9/1989 Inayama ..... 220/6
4,913,302 A * 4/1990 Stonier ..... 220/6
5,038,953 A * 8/1991 Radar ..... 220/6
5,042,674 A * 8/1991 Ramsay et al. ..... 220/4.24
5,064,068 A * 11/1991 Sheng ..... 206/425
5,429,261 A * 7/1995 Machino ..... 220/7
5,651,652 A * 7/1997 Williams et al. ..... 411/508
6,230,916 B1 * 5/2001 Bradford et al. ..... 220/6
6,364,096 B1 * 4/2002 De Baets et al. ..... 206/1.5
6,616,003 B1 * 9/2003 Polenta ..... 220/7
2004/0222221 A1 * 11/2004 Rader ..... 220/6

FOREIGN PATENT DOCUMENTS

JP 06024440 A * 2/1994
JP 06247445 A * 9/1994

* cited by examiner

*Primary Examiner*—Nathan J. Newhouse
*Assistant Examiner*—Harry Grosso
(74) *Attorney, Agent, or Firm*—Scully, Scott, Murphy & Presser, P.C.

(57) ABSTRACT

Collapsible container which includes a carrying base part, a plurality of collapsible side walls and a lid. A first and second side wall are movably attached to an upper frame member via upper hinge members. The first and second side walls are further parted into each an upper and lower section via a vertical folding line. An upper edge of a third and fourth side wall are each provided with at least one locking lip limiting the outwards movement of the third and fourth side walls by interacting with an inner edge of the upper frame member. The lid is provided with an inner rim which is interacting with the inner edge and with the locking lips thereby limiting inward movement of the third and fourth side walls while the lid is arranged on the collapsible container.

5 Claims, 2 Drawing Sheets

COLLAPSIBLE CONTAINER FOR TRANSPORT AND STORAGE OF GOODS

The present invention relates to collapsible container for transport and storage of goods.

Collapsible containers are rather popular since they will make a radical saving of the empty return transport volume possible. Foldable containers are advantageously made of thermoplastic materials which will give light and still sturdy containers which are easy to keep clean. Another advantage is that the tare-weight of such containers is very stable which is not the case with, for example, wood containers where the tare-weight can double when the wood becomes wet. Yet another advantage is that thermoplastic materials do not corrode, which is the case with containers made from metal such as steel and aluminium. Most thermoplastic materials furthermore have a good resistance to chemical substances such as acids and bases, which is not the case with most metals.

A container will have to cope with a vast number of different mechanical strains during its life cycle, and there are some cases where foldable containers of thermoplastic material have not been possible to use due to unfavourable cases of load. It is also desired to have packaging which is difficult to tamper with without leaving clearly visible traces.

It has, through the present invention, been made possible to solve the above mentioned problem so that a collapsible container can be used for the handling of goods. The invention relates to a collapsible container for transport and storage of goods, which container includes a carrying base part, a plurality of collapsible side walls and a lid. The side walls are movably attached to said base part by means of lower hinge members. The side walls are arranged as a first and a second side wall being arranged parallel to each other. There is further a third and a fourth side wall being arranged parallel to each other and adjacent to the first and the second side walls. The first and second side walls are moveably attached to an upper frame member via upper hinge members. The first and second side wall are further parted into each an upper and a lower section via a vertical folding line.

An upper edge of said third and fourth side walls are each provided with at least one locking lip. These locking lips limits the outwards movement of said third and fourth side walls by interacting with an inner edge of said upper frame member. The lid is provided with an inner rim which interacts with the inner edge of the upper frame member. This inner rim furthermore interacts with the locking lips thereby limiting inwards movement of the third and fourth side walls while the lid is arranged on the collapsible container. Undesired collapsing of the collapsible container is hereby prevented while the lid is properly arranged on the container.

A container according to the present invention is preferably manufactured through means of a manufacturing method selected from the group consisting of; injection moulding, vacuum moulding, blow moulding and press moulding. The container is suitably manufactured of a polymeric material selected from the group consisting of; polyethylene, polypropylene, polybutene, polyvinylchloride, polyalkylene-therephtalate, acrylonitrile-butadiene-styrene-copolymer, polyamide, polycarbonate and a combination thereof.

The lid may according to one embodiment of the invention be provided with gripping lid coupling members in at least two opposite edges. These coupling members are intended to interact with corresponding rim coupling members at the upper edge of the upper frame member.

According to a preferred embodiment of the invention the lid is provided with coupling hole members in at least two opposite edges. These coupling hole members are intended to interact with corresponding rim coupling hole members at the upper edge of the upper frame member. The coupling hole members and rim coupling hole members are arranged so as to allowing a sealing pin to be inserted through said coupling hole members and rim coupling hole members.

The sealing pin is preferably provided with snapping wedges and a manoeuvring section. The locking pin is further dimensioned to break at removal whereby unauthorised tampering with said collapsible container is made detectable.

The lid is further suitably provided with an upper rim. This upper rim is dimensioned to receive a footprint of said base part thereby securing vertical alignment of stacked collapsible containers with lids arranged thereon.

The upper frame member preferably allows the lid to be arranged thereon when the collapsible container is in both erected and collapsed state.

The invention is described in more detail together with enclosed illustrations showing a preferred embodiment of the invention whereby, FIG. 1 shows in perspective view a collapsible container 1 with a lid 40.

Figure 1:
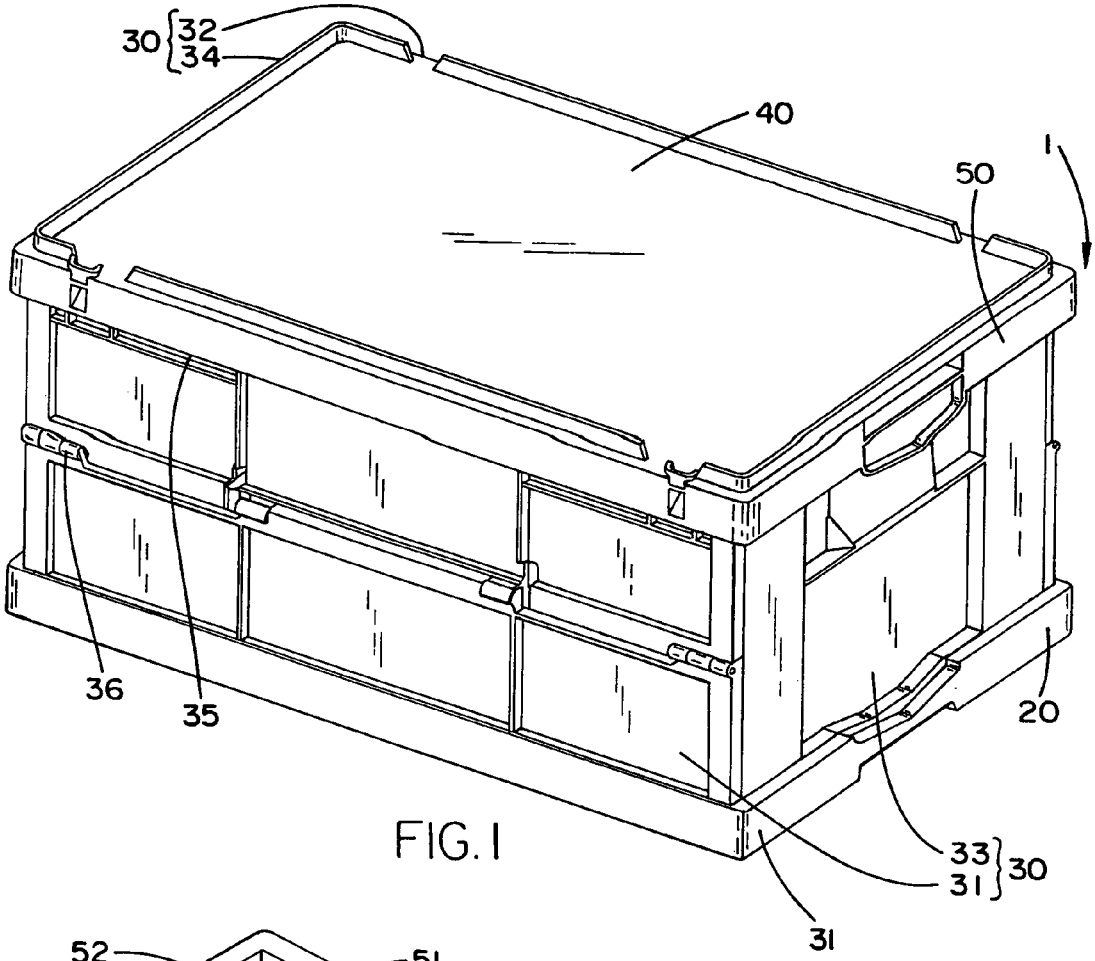

Referring now to FIG. 1 showing a collapsible container 1 for transport and storage of goods. The container includes a carrying base part 20, and four collapsible side walls 30. The side walls are arranged as a first and a second side wall 31 and 32 respectively, being arranged parallel to each other and a third and a fourth side wall 33 and 34 respectively, being arranged parallel to each other and adjacent to the first and the second side walls 31 and 32 respectively. The second and fourth side walls 32 and 34 respectively, are arranged on sides not visible in the FIG. 1. The container is further provided with a lid 40. Said side walls 30 are movably attached to said base part 20 by means of lower hinge members 3. Said first and second side walls 31 and 32 respectively are moveably attached to an upper frame member 50 via upper hinge members 35. The first and second side wall 31 and 32 respectively, are further being parted into each an upper and a lower section via a vertical folding line 36.

Figure 2:
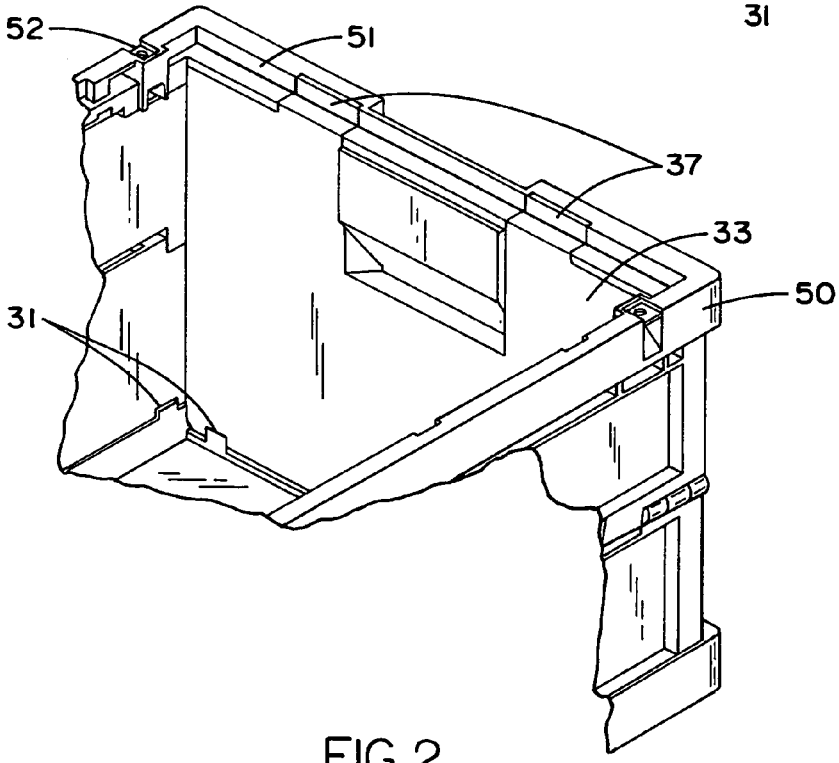
FIG. 2 shows in perspective view upper inside parts of a collapsible container 1.

Referring now to FIG. 2 showing an upper edge of the third side wall 33. Said third and fourth side walls 33 and 34 respectively, are each provided with two locking lips 37. The locking lips 37 limits the outwards movement of said third and fourth side walls 33 and 34 respectively, by interacting with an inner edge 51 of said upper frame member 50.

Figure 3:
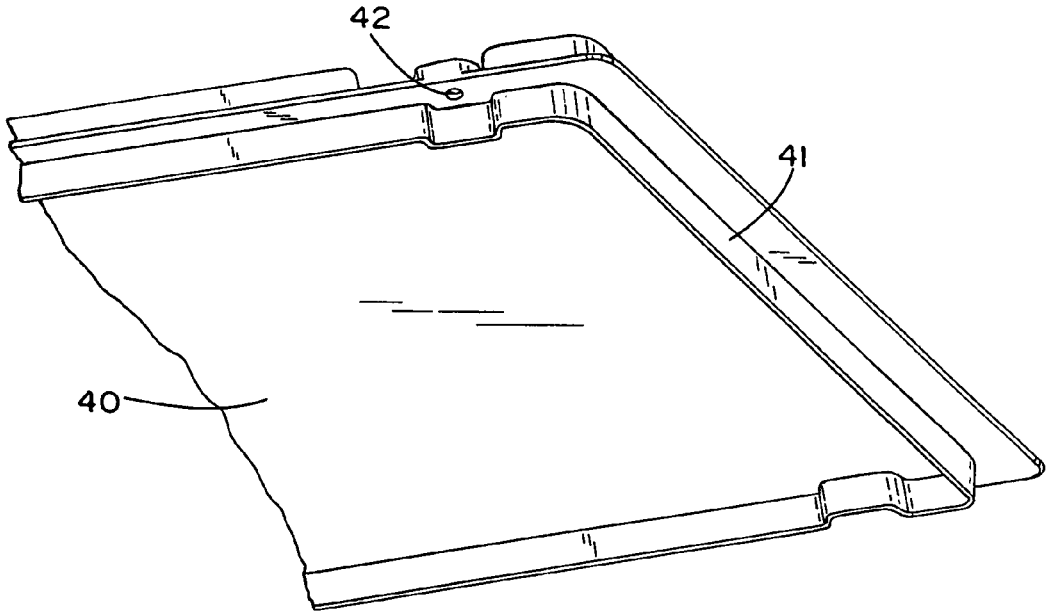
FIG. 3 shows in perspective view a lower side of a lid 40.

Referring now to FIG. 3 showing a lower side of a lid 40. Said lid 40 is provided with an inner rim 41. This inner rim 41 interacts with said inner edge 51 (see FIG. 2) of said upper frame member 50. The inner rim 41 furthermore interacts with the locking lips 37 (see FIG. 2) thereby limiting inwards movement of said third and fourth side walls 33 and 34 respectively (see FIG. 2), while the lid 40 is arranged on the collapsible container 1. Undesired collapsing of said collapsible container 1 is thereby prevented while said lid 40 is properly arranged on said collapsible container 1.

Figure 4:
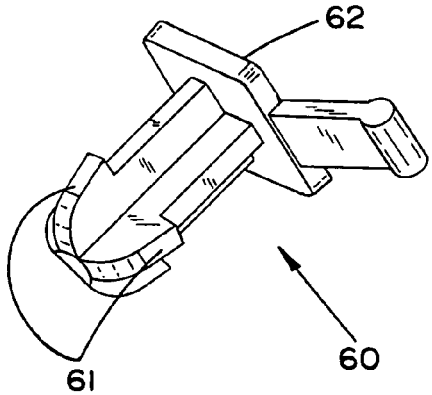
FIG. 4 shows in perspective view an accessory in the form of a sealing pin 60.

The lid 40 is provided with coupling hole members 42 (see FIG. 1) in at least two opposite edges which coupling hole members 42 interacts with corresponding rim coupling hole members 52 (see FIG. 2) at the upper edge of the upper frame member 50. Said coupling hole members 42 and rim coupling hole members 52 are arranged so as to allowing a sealing pin 60 (see FIG. 4) to be inserted through said coupling hole members 42 and rim coupling hole members 52. The sealing pin 60 is provided with snapping wedges 61 and a manoeuvring section 62. According to a special embodiment of the invention the locking pin 60 is dimensioned to break at removal whereby unauthorised tampering with said collapsible container 1 is made detectable. The lid 40, as best seen in FIG. 1, is provided with an upper rim 43. The upper rim 43 is dimensioned to receive a footprint of said base part 20, thereby securing vertical alignment of stacked collapsible containers 1 with lids 40 arranged thereon.

The upper frame member 50 allows the lid 40 to be arranged thereon when the collapsible container 1 is in both erected and collapsed state.

A collapsible container, as herein disclosed, is suitably manufactured through means of injection moulding of polyethylene or polypropylene.

The invention is not limited by the embodiments shown since they can be altered in different ways within the scope of the invention.

We claim:

1. A collapsible container consisting of a rigid polymeric material for the transport and storage of goods, which container includes a carrying base part, an upper frame member, a plurality of collapsible side walls and a lid which is supportable on said upper frame member, said side walls being movably attached to said base part by lower hinge members, said side walls being formed of a first and second side wall being arranged parallel to each other and a third and fourth side wall being arranged parallel to each other and adjacent to the first and second side walls, wherein said first and second side walls are movably attached at upper ends thereof to said upper frame member via upper hinge members, said first and second side wall each being parted into an upper and lower section, said upper and lower wall sections being connected so as to be foldable about a horizontal folding line, wherein an upper edge of said third and fourth side walls are each provided with at least one locking lip, said locking lips limiting the outward movement of said third and fourth side walls relative to the upper frame member by engagingly interacting with an inner edge of said upper frame member, said lid being provided with an inner rim, said inner rim engagingly interacting with said inner edge of said upper frame member, said lid member having external dimensions which are within the confines of said upper frame member, said inner rim furthermore cooperatively engaging with said locking lips thereby limiting inward movement of said third and fourth side walls while said lid is arranged on said collapsible container whereby undesired collapsing of said collapsible container is prevented while said lid is properly arranged on said container, said lid being provided with a plurality of spaced coupling hole members in at least two opposite edges of said lid, said plurality of coupling hole members being aligned with a corresponding plurality of rim coupling hole members spaced at the upper edge of the sidewalls of said upper frame member, a sealing pin being insertable through, respectively, each of said coupling hole members and said rim coupling hole members for locking said lid to said upper frame member, each said sealing pin being provided with snapping wedges and a maneuvering section for engaging the walls of said coupling and rim coupling hole members, and each said sealing pin being dimensioned to break at removal from the inserted position thereof extending through said rim coupling hole member and lid coupling hole member so as to render detectable any unauthorized tampering with said collapsible container.

2. Collapsible container according to claim 1 wherein the container is manufactured through a manufacturing method which is selected from a process consisting of injection molding, vacuum molding, blow molding and press molding.

3. Collapsible container according to claim 1 wherein the collapsible container is manufactured by a polymeric material selected from the group consisting of; polyethylene, polypropylene, polybutene, polyvinylchloride, polyalkylenetherephtalate, acrylonitrile-butadiene-styrene-copolymer, polyarnide, polycarbonate and a combination thereof.

4. Collapsible container according to claim 1 wherein said lid is provided with an upper rim, said upper rim being dimensioned to receive a footprint of said base part thereby securing vertical alignment of stacked collapsible containers leaving lids arranged thereon.

5. Collapsible container according to claim 1 wherein said upper frame member enables said lid to be arranged thereon when the collapsible container is in either an erected or collapsed state.

* * * * *